United States Patent [19]

Tanaka et al.

[11] Patent Number: 4,594,106

[45] Date of Patent: Jun. 10, 1986

[54] SPRAYING MATERIALS CONTAINING CERAMIC NEEDLE FIBER AND COMPOSITE MATERIALS SPRAY-COATED WITH SUCH SPRAYING MATERIALS

[75] Inventors: Minoru Tanaka, Kobe; Kazuhisa Niwano, Miki; Tetsunori Minato, Ako; Yastami Oka, Okayama, all of Japan

[73] Assignee: Tateho Kagaku Kogyo Kabushiki Kaisha, Kariya, Japan

[21] Appl. No.: 582,174

[22] Filed: Feb. 21, 1984

[30] Foreign Application Priority Data

Feb. 22, 1983 [JP] Japan ..... 58-028236
Feb. 22, 1983 [JP] Japan ..... 58-028237

[51] Int. Cl.[4] ..... C09D 5/10

[52] U.S. Cl. ..... 106/1.12; 106/1.13; 106/1.17; 106/14.05; 106/193 M; 106/197.2; 427/423; 524/45; 524/442

[58] Field of Search ..... 427/34, 423; 51/298, 51/303; 252/62; 106/1.05, 1.13, 1.17, 14.05, 193 M, 197.2, 1.12; 524/45, 442

[56] References Cited

U.S. PATENT DOCUMENTS 3,041,190 6/1962 Griffith et al. ..... 252/62
3,109,511 6/1960 Slayter et al. ..... 131/61
3,176,354 4/1965 Blau et al. ..... 252/62
3,432,381 3/1969 Collins ..... 106/242
3,524,286 8/1970 Wohrer ..... 51/298

FOREIGN PATENT DOCUMENTS 2113177 9/1972 Fed. Rep. of Germany .
1434948 3/1966 France .
WO83/1751 5/1983 PCT Int'l Appl. .
742387 12/1955 United Kingdom .

OTHER PUBLICATIONS

Chemical Abstracts, vol. 78, No. 13, Jul. 2, 1973, p. 234, ref. No. 163297b (T. K. Damzova et al.).

*Primary Examiner*—Lorenzo B. Hayes
*Attorney, Agent, or Firm*—Marshall, O'Toole, Gerstein, Murray & Bicknell

[57] ABSTRACT

Flame spraying compositions exhibiting improved adherence to a variety of substrates are disclosed, as well as articles coated with such compositions. The spraying compositions comprise a granulated mixture of two components: (1) a powdery material selected from the group consisting of powdered metals, heat resistant ceramics, cermets, and resins; and, (2) a ceramic needle fiber such as whisker crystals of SiC or $Si_3N_4$. Articles coated with thin films of these coatings exhibit increased thermal and corrosion resistance.

9 Claims, No Drawings

SPRAYING MATERIALS CONTAINING CERAMIC NEEDLE FIBER AND COMPOSITE MATERIALS SPRAY-COATED WITH SUCH SPRAYING MATERIALS

The present invention relates to spraying compositions containing ceramic needle fibers and to composite articles formed when films of such ceramic needle containing coating compositions are sprayed on a substrate.

Methods of melting a spraying material and spray-coating the surface of a base or substrate in order to improve the thermal or chemical resistance of the substrate have been widely practiced (e.g., U.S. Pat. No. 4,055,705). In the case of many materials which should theoretically exhibit very good physical properties, the bond between the sprayed film and the surface of the coated substrate is not strong, and the film tends to crack and peel with the passage of time. Because of these defects, many high temperature or very high temperature spray coating compositions which incorporate metals, ceramics, cermets, or other materials having a high melting point have failed to exhibit the desired characteristics to the full. Coating the surface of a substrate, such as metal, with a resin of low melting point tends to exhibit similar defects.

The bond between the surface of a substrate and a film depends on the composition of the substrate, the substrate's treatment prior to spraying, the nature of the spraying material, and other factors. Even when all of these factors are favorable, it has been very difficult to completely avoid the occurrence of cracks and peeling with the passage of time.

The present invention provides spraying materials which allow formation of a sprayed film having a powerful bond to the coated substrate, irrespective of the nature or type of substrate. The invention likewise discloses composite materials in which the bond between the sprayed film and the base substrate is very large, thereby eliminating cracks and peeling with the passage of time.

These results are accomplished, in part, by admixing a ceramic needle fiber, such as silicon nitride whisker or silicon carbide whisker, with a powdery material such as metal, ceramic, cermet, or resin used in conventional spraying methods. The addition of such a ceramic needle fiber to the coating composition results in a film which is tenaciously bonded to the substrate. The spraying materials of the present invention are further characterized in that the powdery material and ceramic needle fiber components are granulated.

Powdery materials which can be employed in the spraying compositions of the invention include metals such as aluminium, cobalt, nickel, copper, tungsten, molybdenum and other alloys; ceramics having heat resistance, low expansion, and good electrical and magnetic properties, including, but not limited to $Al_2O_3$, $ZrO_2$, MgO, $Cr_2O_3$, $MgO.SiO_2$, $2MgO.2Al_2O_3.SiO_2$, $ZrSiO_4$, $MgTiO_3$, $2MgO.SiO_2$, $MgZrO_3$, and $MgAl_2O_3$; cermets, such as a mixture of 40% $Co+ZrO_2$, a mixture of 40% $Ni+Al_2O_3$, and a mixture of 12% Co+WC; and resins such as polyepoxides and polyamides.

For the ceramic needle fiber component of the present invention, ceramic whiskers are preferred, particularly whiskers of $Si_3N_4$ and SiC. Ceramic whiskers are needle-like single unit crystals of silicon nitride, silicon carbide, or aluminum oxide having a very large aspect ratio. The whisker form of a ceramic material (as opposed to lump crystals of the same material) exhibits a variety of improved properties like thermal shock resistance, low expansion, heat resistance and chemical resistance. In addition to the preferred silicon nitride, and silicon carbide whiskers; other ceramic whiskers such as alumina whisker, and short fibers obtained by cutting other ceramic continuous fibers, (viz., silicon carbide fiber, carbon fiber, and glass fiber) into small pieces can also be employed in the compositions of the present invention.

Silicon nitride or silicon carbide whisker of high purity can be obtained by practicing the invention disclosed in Japanese patent provisional publications No. SHO. 57-196711, No. SHO 58-270799, No. SHO. 58-172298 and No. SHO 58-213698, Japanese patent application No. SHO. 57-233349, or in pending U.S. application Ser. Nos. 06/476,199 and 06/476,200 filed, Mar. 17, 1983.

The ratio of powdery material to ceramic needle fiber in the spraying composition is 100 parts powdery material to 1 to 50 parts, and preferably 3 to 25 parts, ceramic needle fiber by weight. It is desirable to granulate the powdery material and the ceramic needle fiber by employing a binder like carboxymethyl cellulose (CMC). It is also preferred to calcine the resultant granules at 600° to 1400° C. prior to spraying.

When the amount of ceramic needle fiber in the spraying composition is less than 1 part per 100 parts of powdery material, the spraying materials do not exhibit the desired bonding effects. On the other hand, when 50 or more parts of needle fiber are utilized, the properties of the spraying material will be altered. That is, as shown by these figures, the benefits of the present invention are obtained when the ratio of ceramic needle fiber is 1 to 50 parts (desirably 3 to 25 parts) per 100 parts powdery material by weight.

The amount of binder (e.g., CMC) added to the composition should be just enough to aid the granulation of the ingredients—approximately 1 part of binder per 100 parts of composition by weight. This granulation serves to evenly disperse the ceramic needles and to reduce the size of the particles. It has been found that granules of 10 μm to 500 μm in diameter (most desirably, 50 μm to 100 μm in diameter) allow easy spraying.

The coated substrates of the present invention are obtained when granulated mixtures of the above-described powdery materials and ceramic needle fibers, having been formulated in the specified mixing ratios, are flame sprayed over the surface of a base object or substrate. Typical substrates include ceramic refractory materials of low thermal expansion which exhibit resistance to thermal shock, such as SiC, $Si_3N_4$, $Si_2ON_2$, sialon, ZrO, $Al_2O$, cordierite, and mullite porcelain; refractory fire resisting insulating materials using ceramic fiber; and metallic materials like iron, stainless steel and aluminium.

When the spraying compositions are formulated as previously set forth, (1 to 50 parts whisker per 100 parts powdery material by weight), the sprayed film formed on the surface of the substrate maintains the desired properties of the metal, ceramic, cermet, or resin powdery material component as well as acquiring thermal shock resistance, corrosion resistance, improved electric properties, wear resistance, etc., that are inherent properties of silicon nitride or silicon carbide ceramics.

Furthermore, because these ceramic fibers—especially whiskers of $Si_3N_4$, SIC, $Al_2O_3$ and the like—have very great mechanical strength and their form is not impaired by spraying, the resultant film is endowed with a markedly large mechanical strength in comparison with a film containing no such whisker.

The whisker component results in both a fiber reinforcing effect in the sprayed film, and an enhancement in the strength of the bond to the substrate. Moreover, for some substrate materials, the whisker is also effective in reducing the differential thermal expansion between the substrate material and the film, resulting in the elimination of cracking and peeling with the passage of time.

When short fibers obtained by cutting non-whiskery silicon carbide fiber, carbon fiber, glass fiber, or ceramic continuous fiber into small pieces are compounded in the spraying material, a marked fiber reinforcing effect is achieved in comparison with a film without compounding fiber, and problems such as peeling with the passage of time are suppressed.

The surface condition of composite materials obtained when several spraying compositions of the present invention were spray coated onto various substrates was examined by means of a scanning electron microscope. This examination revealed that the ceramic needle fiber component was evenly dispersed in the film, and both powdery material and ceramic whisker were stuck to each other with their surfaces fused together. In particular, it was observed that the form of the ceramic whisker was virtually unchanged, no breakage or cracking was observed, and it was thus confirmed that the reinforcing effect of whisker compounding was marked, including improved mechanical strength.

There are a number of commercial applications wherein the formation of such tough sprayed films would be of substantial benefit: first, to achieve reinforcing effects for fiber reinforced ceramics (FRC), fiber reinforced metals (FRM), and fiber reinforced plastics (FRP); second, to achieve better regulation of differential thermal expansion between a substrate base and the film sprayed thereon; third, there is a need for a tough, porous coating whose heat insulating effects can be counted on; and, fourth, in view of differential thermal expansion, two or three layers of undercoats are usually used in conventional spraying, whereas the present invention has made it possible, in some cases, to do without an undercoat.

Spraying materials according to this invention can be used where resistance to impact, corrosion or wear, or electric characteristics are required. For example, as adiabatic coating of internal combustion engines, or wear-resistant coating of rolling rolls for iron manufacture.

The following examples illustrate the present invention in greater detail.

EXAMPLE 1

A spraying material of the present invention was prepared by evenly mixing 90 parts zirconia ($ZrO_2$.8-w/o $Y_2O_3$) and 10 parts silicon carbide whisker by volume and granulating the mixture with 1 part CMC by weight into particles of 50 to 100 μm in diameter. (This specimen is referred to as specimen 1.) Next, a specimen was prepared for comparative experiment by merely mixing 90 parts zirconia ($ZrO_2$.8w/o $Y_2O_3$) and 10 parts silicon carbide whisker by volume to make an even mixture without any granulation. (This specimen is referred to as specimen 2.) A third specimen was prepared which comprised the above-mentioned zirconia ($ZrO_2$.8w/o $Y_2O_3$) alone. (This specimen is referred to as specimen 3.)

Specimens 1, 2, and 3 were sprayed by plasma flame spraying, under identical conditions, and without any use of undercoats, over Japanese Industrial Standard (JIS) SS-41 iron plates which measured 100 mm long×500 mm wide×2.5 mm thick and which were pretreated by grid blasting only. The thickness of the sprayed film in each case was about 0.1 mm.

The properties of the sprayed films on the objects thus sprayed were examined by dropping an aluminum ball weighing 10.5 g and having a diameter of 17 mm onto the sprayed object under the influence of gravity from an elevation of 300 mm. The object sprayed with the specimen 1 material produced a localized peeling of about 5 mm in diameter only after receiving as many as 300 impacts. In contrast, the sprayed film of specimen 3 exhibited peeling over the entire sprayed surface after not more than 80 impacts. Moreover, in the case of specimen 3, the spray coating was observed to delaminate and peel away from the metal substrate within several seconds to several tens of seconds after the commencement of spraying, after which it was impossible to continue spraying. No such delamination phenomenon was observed for the specimen 1 samples at all.

The spraying materials of specimen 2 did not flow well in the feeding system of the spray device, and it was not possible to spray these non-granulated materials.

In general, when ceramic powder is to be sprayed onto a metallic material, the prior art teaches that it is necessary to give an undercoat of an appropriate alloy beforehand, otherwise the bond between the sprayed film and the base object will be insufficient and peeling will occur easily. As a countermeasure to this problem, special primers, or bond coating systems, have been contrived, for example, the NiCrAlY alloy disclosed in U.S. Pat. No. 4,055,705.

The fact that sprayed-on films of ceramic materials will normally peel away from an untreated surface was also confirmed in the present experiment, e.g., specimen 3. However, the foregoing data demonstrates that it is possible to produce a powerful bond between a metallic substrate and a sprayed film of ceramic material by using the ceramic whisker or ceramic fiber containing spraying material of the present invention, without the provision of an undercoating.

EXAMPLE 2

A specimen of the spraying material of the present invention was prepared by evenly mixing 80 parts of completely stabilized zirconia ($ZrO_2$.12w/o $Y_2O_3$) and 20 parts silicon nitride whisker by volume, adding 1 part CMC by weight, and granulating the mixture into particles of 50 to 100 μm. The granulated composition was sprayed by plasma flame spraying onto an aluminum setter (100 mm×100 m×5 mm thick), forming a coating of 0.5 to 1 mm in thickness. The spray-coated setter was then subjected to 1500° C. heat cycles in an oxidizing atmosphere. No peeling or delamination was observed, even after 400 cycles of heating.

In contrast, a coat of the same completely stabilized zirconia, but formulated without a whisker component, was deposited on the same aluminium setter by plasma flame spraying. The spray coating started to peel around on 150th cycle, and the peeling was conspicuous after 200 cycles.

This peeling resistance phenomenon is believed to be due to the reduced coefficient of thermal expansion of the sprayed film, attributable to the presence of the whisker component. The compounding effect of the present invention narrows the discrepancy between the film's coefficient of expansion and that of the substrate.

EXAMPLE 3

Table I illustrates the results when several spraying materials of the present invention were applied to a variety of bases or substrates.

TABLE I

| | List of Kinds of Spraying Materials | | |
|---|---|---|---|
| Base object or substrate | Spraying material % by volume | Spraying method | Physical properties |
| Soft iron SS41 | $ZrO_2$.SiC whisker 80:20 | Plasma flame spraying | Wear resistance improved. Chemical erosion resistance. |
| Soft iron SS41 | $Al_2O_3$.SiC whisker 85:15 | Plasma flame spraying | Wear resistance improved. Chemical erosion resistance. |
| Soft iron SS41 | Ti.$Si_3N_4$ whisker 80:20 | Flame spraying | Wear hardness, improved. Chemical erosion resistance. |
| $Al_2O_3$ | Cu.$Si_3N_4$ whisker 80:20 | Plasma flame spraying | Electric resistance. Chemical erosion resistance. |
| SiC | $Al_2O_3$.SiC whisker 85:15 | Plasma flame spraying | Oxidation resistance. Chemical |
| SiC | $Al_2O_3$.SiC whisker 80:20 | Plasma flame spraying | Oxidation resistance. Chemical |
| $Al_2O_3$ | $ZrO_2$.SiC whisker 80:20 | Plasma flame spraying | Chemical reaction resistance. |
| $Al_2O_3$ | MgO.$Si_3N_4$ whisker 80:20 | Plasma flame spraying | Chemical reaction resistance. Thermal shock resistance. |
| Sialon | $ZrO_2$.SiC whisker 80:20 | Plasma flame spraying | Chemical reaction resistance. Thermal shock resistance. |
| $Si_2ON_2$ | MgO.$Si_3N_4$ whisker 70:30 | Plasma flame spraying | Oxidation resistance. Chemical reaction resistance. |
| Ceramic | $Al_2O_3$.SiC whisker 70:30 | Plasma flame spraying | High emissivity, hardness and strength. |
| Refractory brick | $ZrO_2$.SiC whisker 80:20 | Plasma flame spraying | High emissivity and hardness |
| Insulating firebrick | $ZrO_2$.SiC whisker 80:20 | Plasma flame spraying | High emissivity and hardness |
| Stainless | $ZrO_2$.$Si_3N_4$ whisker 75:25 | Plasma flame spraying | Heat and wear resistance. |

What is claimed:

1. In a granulated flame spraying composition having particle size with a average diameter in the range 10 micrometers through 500 micrometers comprising the mixture of a binder and a powdery material component selected from the group consisting of powdered metals, heat resistant ceramics, cermets, and resins;

the improvement comprising 1 to 50 parts by weight per 100 parts by weight of said powdery material of a ceramic needle fiber component selected from the group consisting of silicon carbide whisker crystals, silicon nitride whisker crystals and mixtures thereof of silicon carbide whisker crystals said silicon nitride whisker crystals;

wherein said powdery material component and said ceramic needle fiber component are granulated, whereby particles of said flame spraying composition have an average diameter in the range 10 micrometers through 500 micrometers.

2. The flame spraying composition of claim 1, wherein the granulated material has been calcined.

3. The composition of claim 1 wherein said binder material is carboxymethylcellulose.

4. The flame spraying composition of claim 1 wherein said powered metals component is selected from the group consisting of aluminium, cobalt, nickel, copper, tungsten, molybdenum, and alloys of said metals.

5. The flame spraying composition of claim 1 wherein said heat resistant ceramics component is selected from the group consisting of $Al_2O_3$, $ZrO_2$, MgO, $Cr_2O_3$, $MgO.SiO_2$, $2MgO.2Al_2O_3.SiO_2$, $ZrSiO_4$, $MgTiO_3$, $2MgO.SiO_2$, $MgZrO_3$, $MgAl_2O_3$, and mixtures thereof.

6. The flame spraying composition of claim 1 wherein said cermets component is selected from the group consisting of:

(i) a mixture comprising approximately 40% Ni and $Al_3O_3$;

(ii) a mixture comprising approximately 40% Co and $ZrO_2$; and, (iii) a mixture comprising approximately 12% Co and WC.

7. The flame spraying composition of claim 1 wherein said resins component is selected from the group consisting of polyepoxides and polyamides.

8. The flame spraying composition of claim 1 wherein granules of said spraying composition have a diameter in the range 50 μm to 100 μm.

9. The flame spraying composition of claim 1 wherein the amount of said powdery material component is in the range 75 to 97 parts by weight, and the amount of said ceramic needle material component is in the range 3 to 25 parts by weight.

* * * * *